US005699989A

United States Patent [19]

Guthrie

[11] Patent Number: 5,699,989

[45] Date of Patent: Dec. 23, 1997

[54] MAILBOX MOUNTING DEVICE WHICH RETURNS TO ITS ORIGINAL POSITION AFTER SIDE IMPACT

[76] Inventor: James R. Guthrie, R.D. #2 Box 121, Hopwood, Pa. 15445

[21] Appl. No.: 652,360

[22] Filed: May 23, 1996

[51] Int. Cl.[6] ..... B65D 91/00

[52] U.S. Cl. ..... 248/219.2; 248/125.7; 248/131; 232/39

[58] Field of Search ..... 248/548, 125.7, 248/219.2, 289.31, 289.11, 900, 131; 232/39

[56] References Cited

U.S. PATENT DOCUMENTS

| | | | |
|---|---|---|---|
| 3,407,997 | 10/1968 | Wood . | |
| 5,356,072 | 10/1994 | Thomas . | |
| 5,400,958 | 3/1995 | Walker | 232/39 |
| 5,458,286 | 10/1995 | Paschal | 248/131 X |
| 5,622,343 | 4/1997 | Morton | 248/125.7 X |

*Primary Examiner*—Alvin C. Chin-Shue
*Assistant Examiner*—Long Dinh Phan
*Attorney, Agent, or Firm*—Frank A. Wolfe

[57] ABSTRACT

A mailbox mounting device which returns to its original position after side impact being comprised substantially of a horizontal mounting member, a base plate, a cylindrical cap, a spacer mounting plate, and resilient means for retarding the said cylindrical cap from rotating out of place. The cylindrical cap is affixed to the horizontal mounting member by a pin which fits through a hole in the cylindrical cap and through a hole contained in the cylindrical pivot shaft portion of the horizontal mounting member. This locks these two items in place and permits the base plate and the spacer mounting plate which are attached together to rotate about the horizontal mounting member. The base plate and spacer mounting plate are prevented from rotating more than 90 degrees after side impact by the use of two pivot stopping pins which impact the cap pivot stopping pin as the base plate is rotated. The invention also provides for the base plate and therefore the spacer mounting plate to return to its original position by the use of two springs which are permanently attached to the cylindrical cap and the base plate by the use of a spring holding pin and cylindrical cap plate hole.

8 Claims, 3 Drawing Sheets

MAILBOX MOUNTING DEVICE WHICH RETURNS TO ITS ORIGINAL POSITION AFTER SIDE IMPACT

BACKGROUND OF THE INVENTION

The present invention relates to a mailbox mounting device which returns to its original position after side impact.

It is well known that rural mailboxes are subject to damage from various causes, such as snow plows, car mirrors hitting the mailbox during delivery or pick-up of mail or other items, or vandalism. With the present mounting device installed, the mailbox can be struck from either side and it will rotate 90 degrees in either direction, automatically returning to its original position. This mounting device does not hinder opening or closing of the mailbox door and can be used with any style of any rural mailbox. Other devices have, somewhat, addressed this problem, for example see U.S. Pat. Nos. 5,356,072 and 3,407,997. The first device at U.S. Pat. No. 5,356,072 involves a spring loaded side impact device which would allow the mailbox to shift back after being struck but does not provide for the dissipation of energy as the mailbox rotates out of the way from impact. The second device at U.S. Pat. No. 3,407,997, does provide for the mailbox to rotate, but does not provide for the mailbox to return to its original position.

SUMMARY OF THE INVENTION

The present invention relates to a mounting device for a rural mailbox. The device essentially consists of five main components. The first component being a horizontal mounting member. This member enables the device to be mounted to a post or other structure secured to the ground on which the mailbox is generally mounted. The horizontal mounting member has a cylindrical pivot shaft mounted on its top. The second component is a base plate which has a circular hole in its center enabling it to be seated upon and rotated about the cylindrical pivot shaft. The next component is a cylindrical cap which fits upon the cylindrical pivot shaft above the base plate and is locked into place by the use of a cap pivot stopping pin. This pin extends out from the cylindrical cap and serves the additional function of preventing the base plate from rotating more than 90 degrees either clockwise or counter-clockwise about the cylindrical shaft by its interaction with two pivot stopping pins which are permanently attached to the base plate. The next component is a set of two springs. The springs are mounted to the opposite sides of the cylindrical cap and to the base plate in such a manner to retard the base plate from rotating about the cylindrical shaft and which cause the base plate to return to its original position after being rotated about the cylindrical shaft. The final component is a spacer mounting plate. This spacer mounting plate is permanently attached to the base plate and the mailbox, thereby allowing the mailbox to move independently of the horizontal mounting member just as the base plate does.

It is the object of this invention to provide a device that will minimize the damage to a rural mailbox from side impacts and to also cause the mailbox to return to its original position after impact.

DESCRIPTION OF DRAWINGS

This invention will become more readily apparent from the following description of preferred embodiment thereof shown, by way of example only, in the accompanying drawings, wherein.

DESCRIPTION OF THE PREFERRED EMBODIMENT

Figure 2:
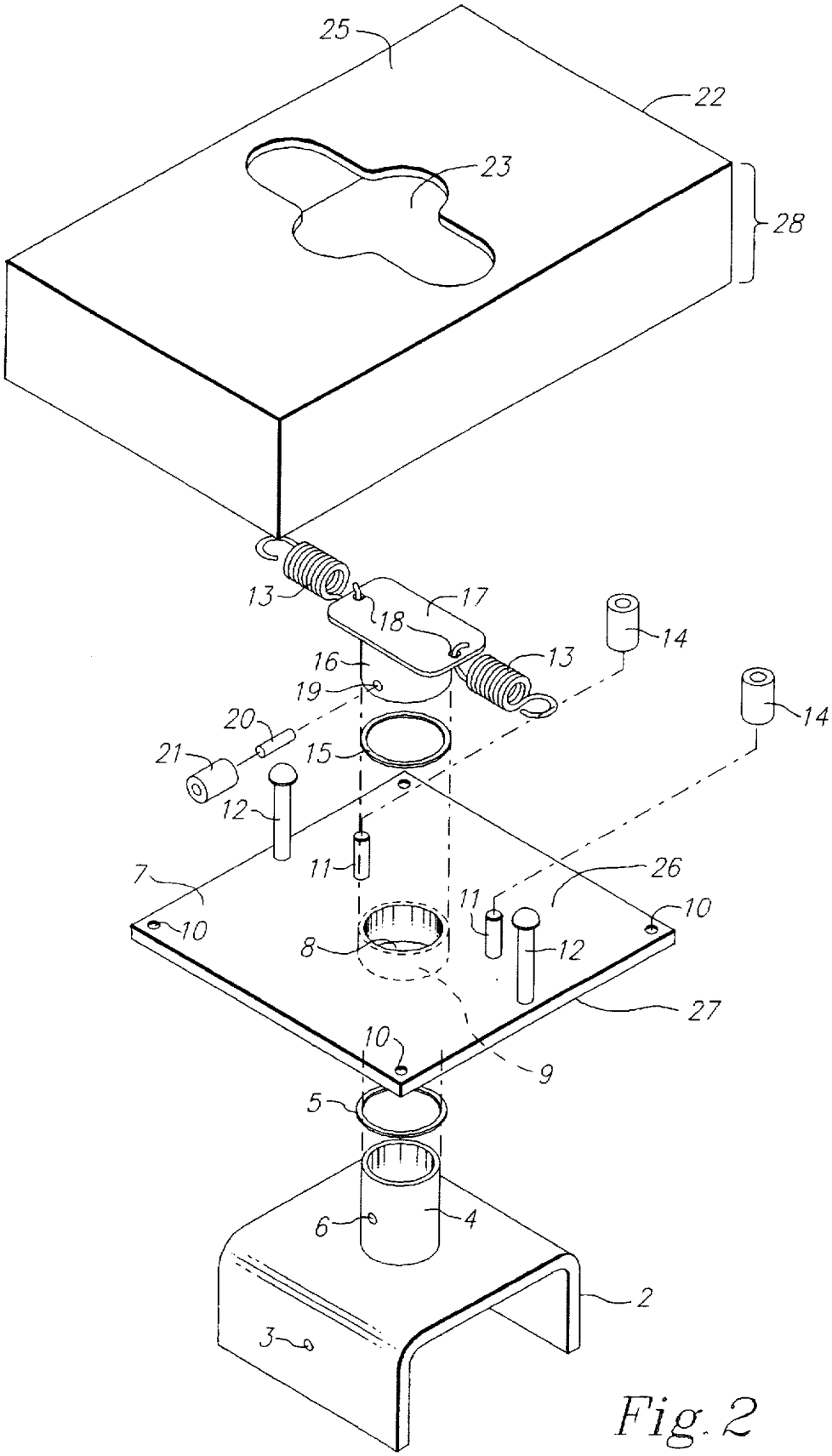
FIG. 2 is a prospective view of the preferred embodiment of mailbox mounting device which returns to its original position after side impact.
Figure 4:
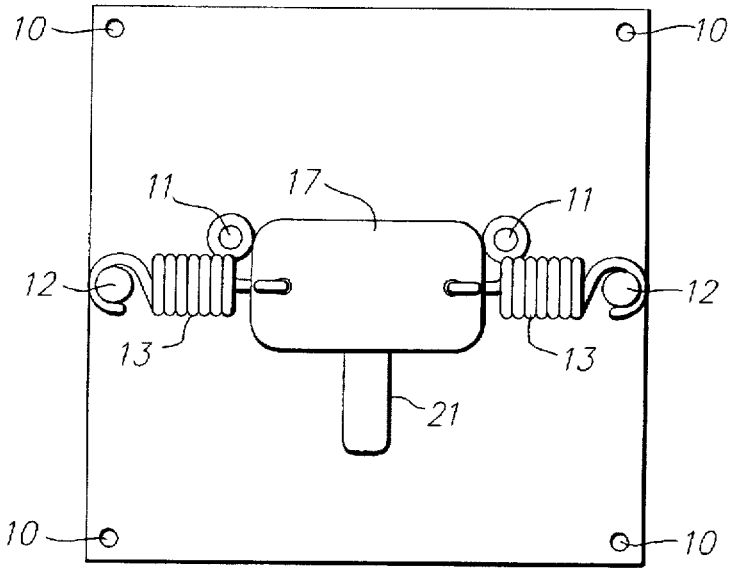
FIG. 4 is a top view of the preferred embodiment of the mailbox mounting device which returns to its original position after side impact.
Figure 5:
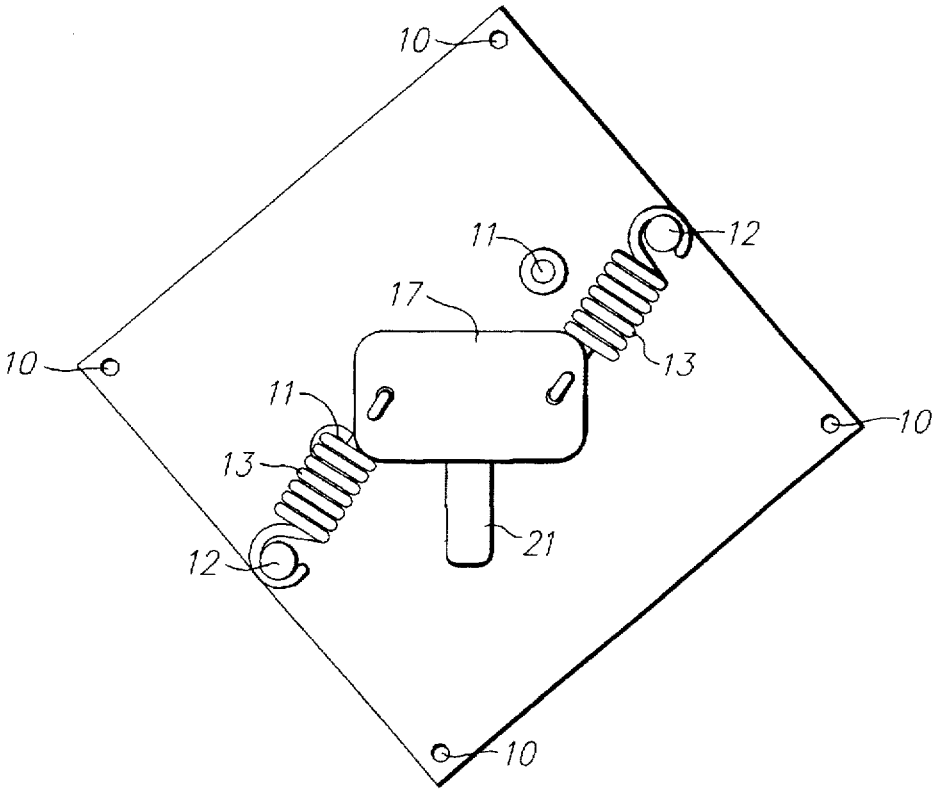
FIG. 5 is a top view of the preferred embodiment of the mailbox mounting device which returns to its original position after side impact, with the base plate rotated out of its original position.

The preferred embodiment of the present invention, mailbox mounting device which returns to its original position after side impact, is illustrated in FIG. 2. The mailbox mounting device which returns to its original position after side impact comprises a horizontal mounting member 2, a base plate 7, a cylindrical cap 16, a spacer mounting plate 22, means 20 to permanently attach the said horizontal mounting member 2 to the said cylindrical cap 16, and resilient means 13 to retard the said cylindrical cap 16 from rotating out of position.

Figure 1:
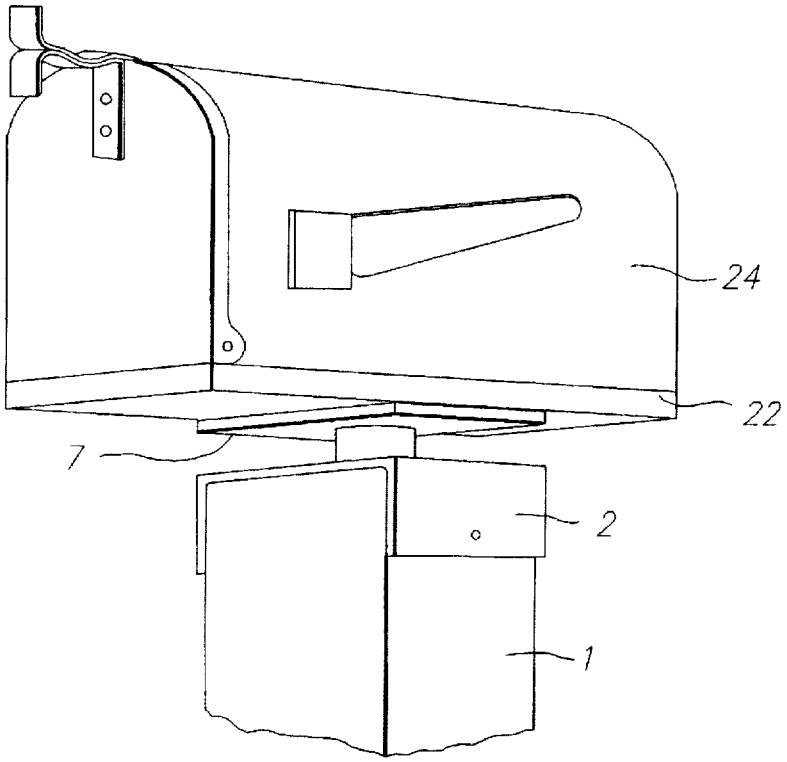
FIG. 1 is a prospective view of a mailbox and mailbox post permanently attached to the preferred embodiment of the mailbox mounting device which returns to its original position after side impact.
Figure 3:
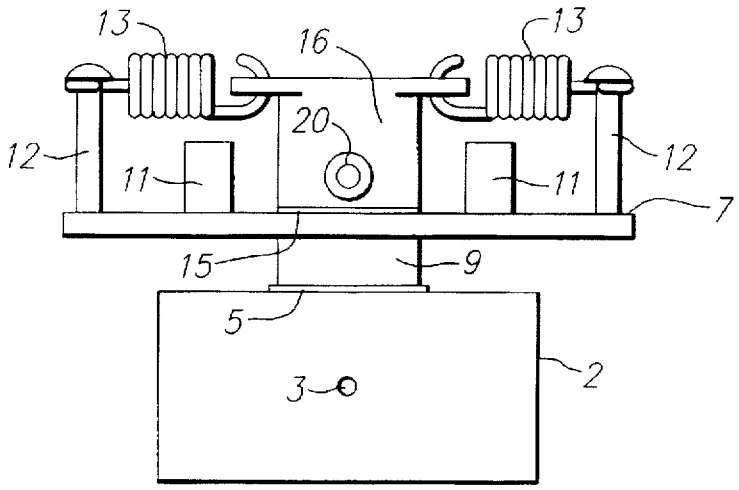
FIG. 3 is a side view of the preferred embodiment of the mailbox mounting device which returns to its original position after side impact.

The said horizontal mounting member 2, as illustrated in FIGS. 1 and 2, is permanently attached to a mailbox post 1. The said horizontal mounting member 2 contains a horizontal mounting member hole 3 which enables the said horizontal mounting member 2 to be permanently attached to the said mailbox post 1. The said horizontal mounting member 2 has a permanently attached cylindrical pivot shaft 4, which contains a cylindrical pivot shaft hole 6. A cylindrical pivot shaft washer 5 is fitted over the outside diameter of the said cylindrical pivot shaft 4.

The next member is the said base plate 7 which is mounted above and upon the said cylindrical pivot shaft 4, the said base plate 7 having a hollow mounting cylinder 9 permanently attached to the bottom of said base plate 27, whereby, said hollow mounting cylinder 9 has an inside diameter substantially equal to the outside diameter of the said cylindrical pivot shaft 4. The said base plate 7 also contains a circular hole 8 which has a diameter substantially equal to the outside diameter of the said cylindrical pivot shaft 4. A base plate washer 15 is fitted over the outside diameter of the said cylindrical pivot shaft 4 on the top of the said base plate 26. The said base plate 7 also contains two spring holding pins 12 which form the mounting position for each of the said resilient means 13. Furthermore, the said base plate 7 contains two pivot stopping pins 11, such that, they interact with the cap pivot stopping pin 20 in such a manner to prevent the said base plate 7 from rotating more than 90 degrees either clockwise or counter-clockwise in its horizontal plane. The said pivot stopping pins 11 each have on their outside a pivot stopping pin bushing 14 which is comprised of a material which would enable the impact with the said cap pivot stopping pin 20 to be lessened upon the said pivot stopping pins 11.

Finally, the said base plate 7 also contains a plurality of mounting holes 10 which are used to permanently attach the said base plate 7 to the said spacer mounting plate 22.

The next member is the said cylindrical cap 16 which is mounted over the said cylindrical pivot shaft 4, such that, the inside diameter of the said cylindrical cap 16 is essentially equal to the outside diameter of the said cylindrical pivot shaft 4. The said cylindrical cap 16 also contains a cylindrical cap plate 17 which contains two cylindrical cap plate holes 18, for the purpose of mounting the end of the said resilient means 13 which is not mounted to the said spring holding pin 12. The said cylindrical cap 16, also contains a cylindrical cap hole 19, which provides for the said cap pivot stopping pin 20 to be inserted, such that, the said cap pivot stopping pin 20 will pass through the said cylindrical cap hole 19 and also through the said cylindrical pivot shaft hole 6, in such a manner to lock the said cylindrical cap 16 and said cylindrical pivot shaft 4 together. The said pivot cap stopping pin 20 also has on its outside a cap pivot stopping pin bushing 21 which is comprised of a material which would enable the impact to be lessened between the said cap pivot stopping pin 20 and the said pivot stopping pins 11.

The spacer mounting plate 22 contains a spacer mounting plate hole 23, which is of sufficient size to permit the said cylindrical pivot shaft 4, said cylindrical cap 16, said cylindrical cap plate 17, said cap pivot stopping pin 20, said spring holding pins 12, said pivot stopping pins 11, said pivot stopping pin bushings 14, said cap pivot stopping pin bushing 21, and said resilient means 13 to all fit through, and said spacer mounting plate 22 being of a sufficient thickness 28 to insure that none of the above stated components will protrude beyond the top of the said spacer mounting plate 25. Finally, the mailbox 24 is permanently attached to the top of the said spacer mounting plate 25.

What is claimed is:

1. A mailbox to post mounting device, comprising:

(a) a horizontal mounting member having a cylindrical pivot shaft on its top;

(b) a base plate mounted upon said cylindrical pivot shaft having a base plate hole through its central axis perpendicular to the top of said base plate sufficient to allow said cylindrical pivot shaft to fit through;

(c) a cylindrical cap mounted upon and permanently attached to said cylindrical pivot shaft having a cap pivot stopping pin extending radially outward;

(d) resilient means, connected between said cylindrical cap and the said base plate, for said base plate from rotating out of position;

(e) a pivot stopping pin attached to the top of said base plate to interact with said cap pivot stopping pin in order to prevent said base plate from rotating more than 360 degrees in relation to said cylindrical cap; and (f) a spacer mounting plate being permanently attached to the top of said base plate and having a hole of sufficient size that said cylindrical cap, said cap pivot stopping pin, said resilient means, and said pivot stopping pin can all fit through, and having sufficient thickness to provide that said cylindrical pivot shaft, said cylindrical cap, said cap pivot stopping pin, said resilient means and said pivot stopping pin do not protrude beyond the top of said spacer mounting plate, and having a shape which is compatible with said mail box.

2. The mailbox to post mounting device as recited in claim 1, in which said base plate also has a hollow mounting cylinder attached to the bottom of said base plate directly beneath said base plate hole having an inside diameter substantially equal to the diameter of said base plate hole and the outside diameter of said cylindrical shaft.

3. The mailbox to post mounting device as recited in claim 1, in which said resilient means is comprised of two springs aligned in a straight line on either side of said cylindrical cap and each said spring being permanently attached to said cylindrical cap by using of a cylindrical cap plate hole on one end and permanently attached to the said base plate by using of a spring holding pin at other end.

4. The mailbox to post mounting device as recited in claim 1, in which said cylindrical cap is permanently attached to said cylindrical pivot shaft by said cap pivot stopping pin extending through both said cylindrical cap and said cylindrical pivot shaft, thereby locking said cylindrical cap and said cylindrical pivot shaft together.

5. The mailbox to post mounting device as recited in claim 1, further comprising:

(g) means to permanently attach said horizontal mounting member to said post.

6. The mailbox to post mounting device as recited in claim 1, further comprising:

(g) means to permanently attach said mailbox to said spacer mounting plate.

7. The mailbox to post mounting device as recited in claim 1, further comprising two said pivot stopping pins attached to the top of said base plate to interact with said cap pivot stopping pin in order to prevent said base plate from rotating more than 90 degrees either clockwise or counter-clockwise in relation to said cylindrical cap.

8. A mailbox to post mounting device comprising:

(a) a horizontal mounting member having a cylindrical pivot shaft on its top;

(b) a base plate mounted upon said cylindrical pivot shaft having a base plate hole through its central axis perpendicular to the top of said base plate sufficient to allow said cylindrical pivot shaft to fit through;

(c) a hollow mounting cylinder attached to the bottom of said base plate beneath the said base plate hole and having an inside diameter substantially equal to the diameter of said base plate hole and outside diameter of the said cylindrical shaft;

(d) a cylindrical cap mounted upon and permanently attached to said cylindrical pivot shaft by said cap pivot stopping pin extending through both said cylindrical cap and said cylindrical pivot shaft, thereby locking said cylindrical cap and said cylindrical pivot shaft together, with said cap pivot stopping pin extending radially outward from said cylindrical cap;

(e) resilient means comprised of two springs aligned in a straight line on either side of said cylindrical cap and each said spring being permanently attached to said cylindrical cap by using of a cylindrical cap plate hole on one end and permanently attached to said base plate by the using of a spring holding pin at other end;

(f) a plurality of pivot stopping pins attached to the top of said base plate to interact with the said cap pivot stopping pin in order to prevent said base plate from rotating more than 90 degrees clockwise or counter-clockwise in relation to said cylindrical cap;

(g) a spacer mounting plate being permanently attached to the top of said base plate and having a hole of sufficient size that said cylindrical cap, said cap pivot stopping pin, said resilient means, and said pivot stopping pins can all fit through, and having sufficient thickness to provide that the said cylindrical pivot shaft, said cylindrical cap, said cap pivot stopping pin, said resilient means and said pivot stopping pins do not protrude beyond the top of said spacer mounting plate, and having a shape which;

(h) means to permanently attach said horizontal mounting member to said post; and (i) means to permanently attach said mailbox to said spacer mounting plate.

* * * * *